US005676110A

United States Patent [19]

Meneely

[11] Patent Number: 5,676,110

[45] Date of Patent: Oct. 14, 1997

[54] EXHAUST BRAKE WITH OFFSET BUTTERFLY AND METHOD OF REDUCING BACK PRESSURE THEREIN

[76] Inventor: Vincent Allan Meneely, 9837 McKinnon Crescent, R.R. No. 10, Langley, British Columbia, Canada, V3A 6Y5

[21] Appl. No.: 615,951

[22] Filed: Mar. 14, 1996

[51] Int. Cl.[6] ..... F02D 9/06

[52] U.S. Cl. ..... 123/323

[58] Field of Search ..... 123/323; 60/324; 128/154, 273; 137/513.3, 522, 527, 630.12

[56] References Cited

U.S. PATENT DOCUMENTS

| | | | |
|---|---|---|---|
| 3,234,924 | 2/1966 | May | 123/323 |
| 3,523,418 | 8/1970 | Marsee | 123/323 |
| 3,751,921 | 8/1973 | Blomberg et al. | 60/324 |
| 4,111,166 | 9/1978 | Alstrin et al. | 123/97 B |
| 4,707,987 | 11/1987 | Atkin | 60/324 |
| 4,819,696 | 4/1989 | Takikawa et al. | 137/630.12 |
| 5,355,673 | 10/1994 | Sterling et al. | 60/324 |
| 5,362,285 | 11/1994 | Sano et al. | 477/92 |
| 5,372,109 | 12/1994 | Thompson et al. | 123/323 |
| 5,392,812 | 2/1995 | Herron | 137/527.8 |
| 5,394,901 | 3/1995 | Thompson et al. | 137/513.3 |
| 5,445,248 | 8/1995 | Clarke et al. | 188/273 |
| 5,452,578 | 9/1995 | Barber | 60/324 |

FOREIGN PATENT DOCUMENTS

| | | | |
|---|---|---|---|
| 93304438 | 1/1994 | European Pat. Off. | 123/323 |

*Primary Examiner*—Raymond A. Nelli
*Attorney, Agent, or Firm*—Norman M. Cameron

[57] ABSTRACT

An exhaust brake for an internal combustion engine has a valve body with an exhaust gas conduit therethrough. The conduit has a center, an upstream portion and a downstream portion. The upstream portion is smaller in cross-section than the downstream portion. There is a butterfly valve member in the conduit of the valve body between the upstream portion and the downstream portion. The valve member has a cross-section and is positioned to closely fit the upstream portion when the valve member is closed. The valve member has a center and is pivotally mounted on a pivot which is offset with respect to the center of the conduit and offset from the valve member, whereby gas pressure in the upstream portion of the conduit acting against the valve member can rotate the valve member about the pivot.

21 Claims, 2 Drawing Sheets

EXHAUST BRAKE WITH OFFSET BUTTERFLY AND METHOD OF REDUCING BACK PRESSURE THEREIN

BACKGROUND OF THE INVENTION

This invention relates to exhaust brakes typically used on large, diesel powered vehicles and, in particular, to exhaust brakes which have a pressure relief feature in the form of an offset butterfly valve.

Exhaust brakes are often used on large, diesel powered vehicles to slow the vehicles on long, downhill sections of road without undue wear on the conventional wheel brakes. The principle of operation involves blocking the outflow of exhaust gases from the engine. The back pressure tends to slow the engine, thus giving the braking effect. For example, some exhaust brakes are connected to the discharge of turbochargers for engines so equipped.

One problem relating to exhaust brakes is the possibility that too much back pressure will cause valve float in the engine. To prevent this problem, an orifice can be provided in the butterfly or the butterfly can be cocked to provide leakage past the butterfly so the maximum pressure cannot be exceeded. However the setting is typically done for a specified engine speed. This means that when the engine turns slower, there may not be enough braking effect because leakage past the butterfly is then too great for the reduced flow of air through the valve.

It would be desirable to set a maximum pressure which would be applicable for a wide range of engine speeds to flatten the torque curve. However this means that more leakage is required at high RPM's than at lower RPM's. Prior art engine brakes do not typically address this problem.

Another problem with some prior art exhaust brakes is leakage of exhaust gases around the shaft supporting the butterfly. This occurs because the shaft is typically centered at the location where high pressure exhaust gases build up during brake operation.

Accordingly it is an object of the invention to provide an improved exhaust brake which overcomes deficiencies in prior art exhaust brakes.

It is also an object of the invention to provide an improved exhaust brake with a butterfly which is offset further than in prior art brakes with offset butterflies.

It is also an object of the invention to provide an improved exhaust brake which can maintain a relatively constant pressure limit through a wide range of engine RPM's.

It is a further object of the invention to provide an improved engine exhaust brake where the butterfly can be opened by excessive pressure without requiring displacement of the piston of its hydraulic or pneumatic actuator.

It is the still further object of the invention to provide an improved engine exhaust brake where the shaft pivotally supporting the butterfly is isolated from high pressure exhaust gases.

It is yet another object of the invention to provide an improved engine exhaust brake where a relatively small movement of the butterfly can permit a large volume of gas to pass by the butterfly.

SUMMARY OF THE INVENTION

In accordance with these objects, there is provided according to one aspect of the invention an exhaust brake for an internal combustion engine. The brake includes a valve body having an exhaust gas conduit therethrough. The conduit has a longitudinal center. A butterfly valve member in the conduit of the valve body has a cross-section to closely fit the conduit when the valve member is closed. The valve member is pivotally mounted on a pivot which is offset with respect to the center of the conduit and offset away from the valve member.

The conduit preferably has an upstream portion and a downstream portion. The valve member is between the upstream portion and the downstream portion. The pivot is offset into the downstream portion.

The valve member may be disk-like with a larger portion on one side of the pivot having a concave surface facing the upstream portion of the conduit.

The pivot may include a shaft extending rotatably through the valve body. The brake has an actuator operatively connected to the shaft for opening or closing the valve member. The actuator may be a fluid actuator having a cylinder with opposite ends. There is a piston reciprocatingly mounted in the cylinder. A piston rod extends slidably through an aperture in one end of the cylinder. There is means for movably connecting the rod to the piston. When the gas pressure rotates the valve member, the shaft can rotate and the rod can move without displacing the piston.

The piston rod may extend slidably through an aperture in the piston and have spaced-apart stop members mounted thereto which permit limited displacement of the piston rod with respect to the piston between the stops.

DESCRIPTION OF THE PREFERRED EMBODIMENTS

Figure 1:
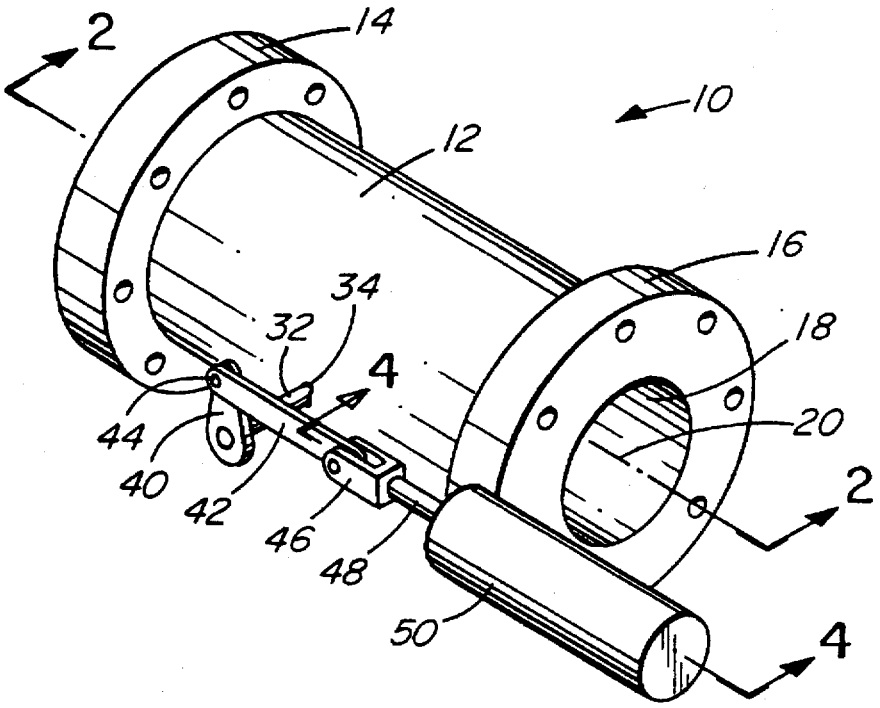
FIG. 1 is simplified, isometric view of an exhaust brake according to an embodiment of the invention.

Referring to the drawings, and first to FIG. 1, this shows an exhaust brake 10 according to an embodiment of the invention. The valve has a body 12 having mounting flanges 14 and 16 which permit it to be connected to the exhaust system of a engine, for example on the exhaust outlet of a turbocharger.

Figure 2:
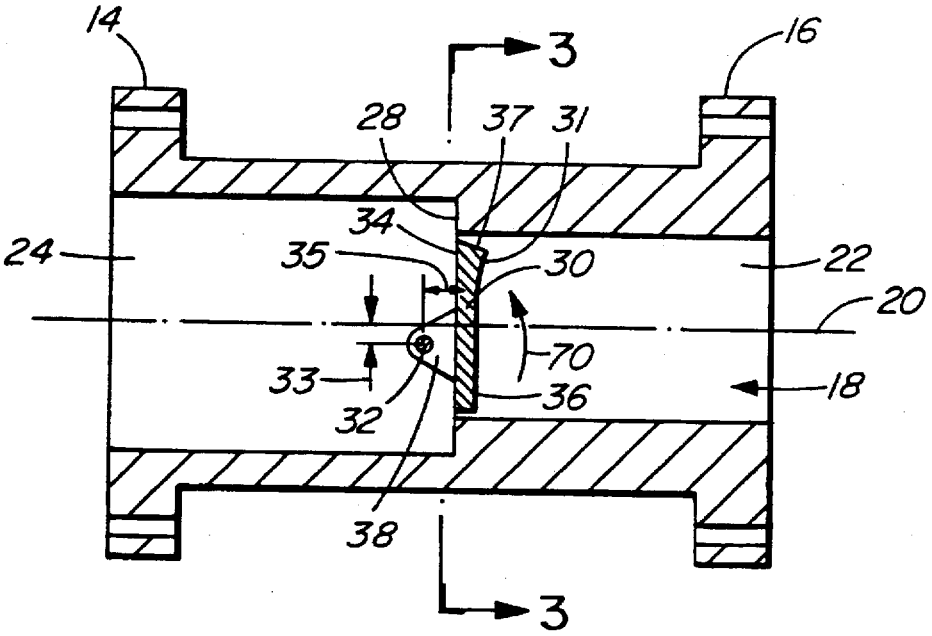
FIG. 2 is a sectional view taken along line 2—2 of FIG. 1.

There is an exhaust gas conduit 18 through the body 12. The conduit has a longitudinal center line 20 which, in this embodiment, coincides with the longitudinal center of the valve body 12. The conduit has an upstream portion 22 and a downstream portion 24 as seen in FIG. 2. It may be seen that the upstream portion is smaller in cross-section than the downstream portion. Both sections are circular in this example. An annular shoulder 28 is formed on the inside of the valve body where the upstream portion and downstream portion meet. This position is generally midway between the flanges 14 and 16 in this example. There is a butterfly valve member 30 in the conduit 18 at this position where the upstream portion and downstream portion meet. When closed it extends along a plane perpendicular to the center line 20 as seen in FIG. 2. The valve member has a cross-section such as to block the upstream portion 22 of the conduit when closed as seen in FIG. 2. Clearances around the valve member are exaggerated in the drawing however. The valve member is disk-shaped to fit the cross-section of the upstream portion of the conduit. In this preferred embodiment the valve member has a scoop-like or concave surface 31 facing upstream portion 22.

Figure 3:
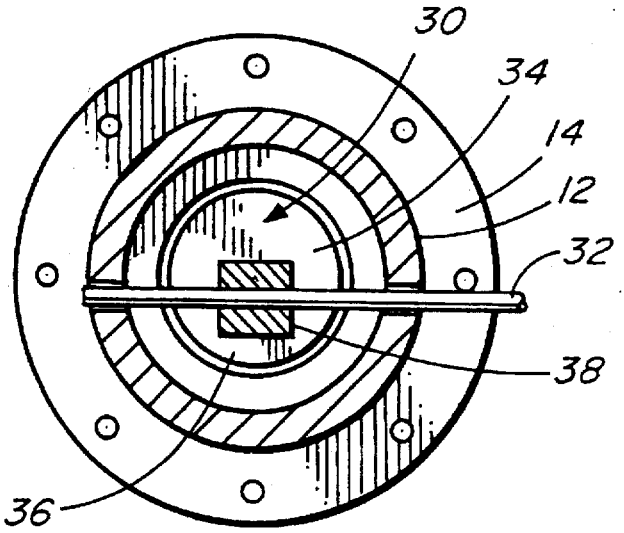
FIG. 3 is a sectional view taken along line 3—3 of FIG. 2.

The valve member is pivotally mounted within the valve body 12 by means of shaft 32 shown in FIGS. 1–3. This shaft passes rotatably through an aperture in the valve body 12 at a position 34 shown in FIG. 1. Low friction bearings may be used to rotatably support the shaft such as carbon/graphite type bearings.

It may be observed best in FIG. 2 that the shaft 32 is offset in two ways. First, it has an offset indicated by arrows 33 with respect to the center line 20 of the conduit and accordingly from the center of the disk-shaped valve member 30. This offset is downwards from the point of view of FIG. 2. The effect of this is to provide two portions of the butterfly, a larger portion 34 on one side of shaft and a smaller portion 36 on the other side of the shaft. The scoop-like surface 31 is on the upstream side of portion 34.

The shaft 32 is offset in a second manner which can also be observed by arrows 35 in FIG. 2. The shaft is offset from the position of the valve member 30 itself and is located in the downstream portion 24 of the conduit 18. A member 38 connects the valve member to the shaft.

Referring back to FIG. 1, the shaft is rigidly connected to a lever arm 40 which extends at right angles therefrom. The lever arm 40 is pivotally connected to a rod 42 by a link pin 44. The rod 42 is connected to clevis 46 on piston rod 48 of a fluid actuator 50 best seen in FIG. 4. A pneumatic actuator is used in this preferred embodiment but a hydraulic actuator may be substituted.

Figure 4:
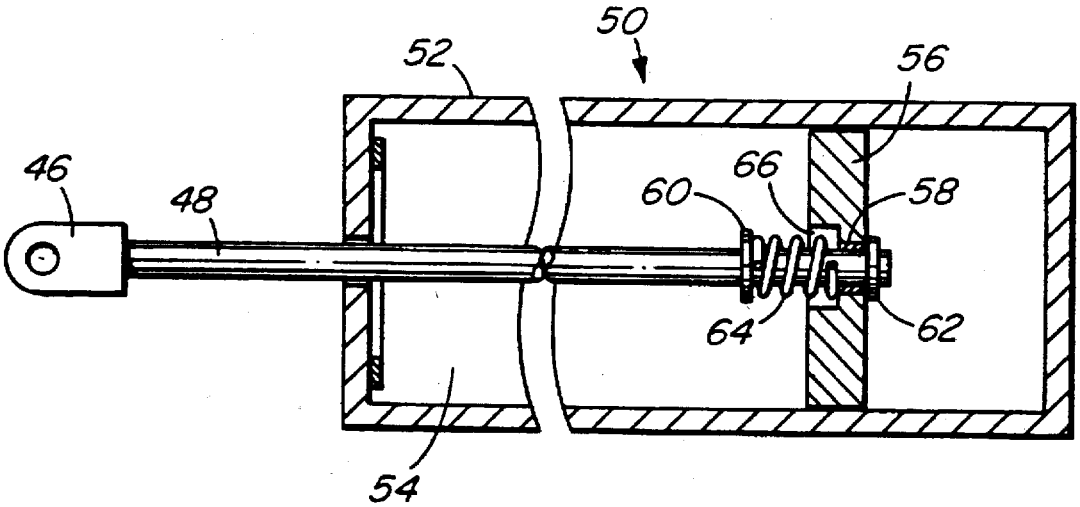
FIG. 4 is a simplified, sectional view of the fluid actuator taken along 4—4 of FIG. 1.

Referring to FIG. 4, the actuator 50 is generally conventional, having a cylinder 52 with a cylindrical, hollow interior 54. Them is a piston 56 reciprocatingly mounted inside the cylinder. In a conventional cylinder, the piston would be rigidly connected to the piston rod 48. However in the actuator according to the invention, piston 56 is slidable on the piston rod 48 which extends through aperture 58 in the piston. There are two stops in the form of snap rings 60 and 62 connected at spaced-apart positions along the piston rod 48 near the end opposite the clevis 46. There is a coil spring 64 extending around the shaft between the stop 60 and recess 66 in the piston 56 which allows the piston rod to move a limited distance with respect to the cylinder without moving the piston in the cylinder. The stop 60 can approach the piston with compression of spring 64 until the spring is fully compressed.

OPERATION

The exhaust brake is operated by closing the butterfly valve member 30 by rotating it to the position shown in FIG. 2 using the actuator 50. This is accomplished using conventional controls in the cab of the vehicle. However the brake 10 is designed to relieve the pressure built up in the exhaust system once it reaches a pre-set limit. This limit is set below the pressure which will cause valve float in the engine. For example, the desired maximum pressure may be 50 psi. Once this pressure is reached, the butterfly valve member 30 is designed to rotate open by movement in the direction indicated by arrow 70 in FIG. 2. This movement occurs because a higher force acts on the larger portion 34 of the valve member compared with the smaller portion 36 on the opposite side of shaft 32. The exact amount of pressure which causes this depends upon a number of factors such as the size of the valve member, the relative sizes of the two portions of the valve member, the strength of spring 64 and friction in the system. These factors are considered when designing an exhaust brake to relieve pressure at the desired point.

Locating the valve member at the position adjacent the shoulder 28 allows it to rotate despite the offset of shaft 32 from the center line 20 of the conduit. It may be seen that the larger portion 34 of the valve member is free to rotate into the larger diameter portion 24 of the conduit despite the offset. At the same time a relatively small amount of rotation of the valve member causes the smaller portion 36 of the butterfly to move quickly away from the inside of the valve and allows a larger volume of gases to pass by the valve member. This degree of opening would not occur if the valve member were located in a conduit of constant diameter. The rapid opening causes gas to be dumped easily with small shaft movements.

The degree of offset from the center line 20 of the conduit, represented by arrows 33 in FIG. 2, is permitted in part by the structure described above where the conduit has a larger cross-section downstream of the valve compared to the cross-section of the conduit where the valve is placed. There is however a second factor which is the offset represented by arrows 35 between the location of the valve along the conduit and the position of the shaft 32. This offset also allows the offset from the center line 20 to be greater than in a conventional valve where interference would occur between the valve and the inside bore of the gas conduit 18 if the offset from the center line were too great. The valve opens to a position along center line 20 of the conduit 18 if the offsets represented by arrows 33 and 35 are equal. This position would be horizontal from the point of view of FIG. 2. The offset represented by arrows 35 could be used to increase the amount of offset from center line 20 represented by arrows 33, compared to a conventional valve, with or without a larger cross-section downstream portion 24 of the conduit as shown. Likewise the larger cross-section downstream portion could be used alone to increase the permissible offset represented by arrows 33. In this preferred embodiment however, the two means are employed to maximize the offset from center line 20.

Figure 5:
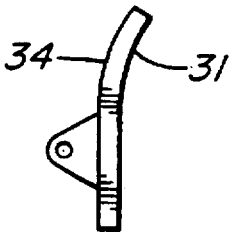
FIG. 5 is a side elevation of an alternative butterfly.

The scoop-like or concave surface 31 is used to increase the torque on shaft 32 as the butterfly is opened. This is desirable because of the increased force necessary to compress spring 64 as the butterfly opens as described below. The increase in the torque is improved when the downstream side of the butterfly is kept straight as seen in FIG. 2. However, the force could also be increased by simply keeping the thickness of the butterfly even and bending it at portion 34 to provide the concave surface 31 as seen in FIG. 5.

Also, while smaller portion 36 of the butterfly moves quickly away from the wall of conduit 18 as the valve opens, larger portion 34, in particular its bevelled edge 37, stays adjacent the wall of the conduit longer. This increases the torque opening valve as the valve opens. This is desirable to counter the increased compressional force of spring 64 as described below.

The total force acting on the closed butterfly does not change because of the offset of the shaft. However, the torque tending to open the valve increases considerably with the amount of offset from center line 20. The invention attempts to increase this force in relation to the friction in the shaft caused by the force of the exhaust gases acting against the butterfly. The increased offset permitted by the invention, and accordingly greater opening force on the butterfly, means that the friction in the shaft and other components of the exhaust brake become a smaller fraction of the torque which tends to open the butterfly.

As suggested above, the rotation of the valve member causes rotation of the shaft 32, lever arm 40 and displacement of rod 42 and piston rod 48 towards the piston 56 shown in FIG. 2. However this movement actually compresses the spring 64 as stop 60 approaches the piston. Thus the butterfly valve member can open without requiting a large force to do so which would be the case if it had to overcome friction between the piston 56 and the inside of the cylinder 52.

Referring to the second type of offset in the shaft 32, as disclosed above the shaft is located in the downstream portion 24 of the conduit 18. Thus the shaft is isolated from high pressure gases in the upstream portion 22 when the valve member is closed as shown in FIG. 2. The leakage of exhaust gases about the shaft is therefore significantly reduced or eliminated.

The higher the speed of the engine the greater the volume of air entering the exhaust brake and accordingly the greater the pressure acting against the valve member. The greater air flow therefore opens the valve member further in the direction of arrow 70. Thus there is a proportional response whereby the valve opens further as it is required to do so to accommodate greater volumes of air at higher engine speeds.

It will be understood by someone skilled in the art that many of the details provided above are by way of example only and are not intended to limit the scope of the invention as set out in the following claims.

What is claimed is:

1. An exhaust brake for an internal combustion engine, comprising:

a valve body having an exhaust gas conduit therethrough with a longitudinal center; and a butterfly valve member in the conduit of the valve body which has a cross-section shaped to closely fit the conduit when the valve member is closed, the valve member being pivotally mounted on a pivot which is offset with respect to the center of the conduit and spaced apart from away from the valve member.

2. An exhaust brake as claimed in claim 1, wherein the conduit has an upstream portion and a downstream portion, the valve member being between the upstream and the downstream portion and the pivot being offset into the downstream portion.

3. An exhaust brake as described in claim 2, wherein the upstream portion has a smaller internal cross-section than the downstream portion, the valve member being positioned and shaped to fit the upstream portion when closed.

4. An exhaust brake as claimed in claim 3, wherein the conduit is circular in section.

5. An exhaust brake as claimed in claim 3, wherein the offset from the longitudinal center of the conduit equals the offset into the downstream portion.

6. An exhaust brake as claimed in claim 2, wherein the pivot includes a shaft extending rotatably through the valve body, the brake having an actuator operatively connected to the shaft for opening or closing the valve member.

7. An exhaust brake as claimed in claim 3, wherein the actuator is a fluid actuator having a cylinder with opposite ends, a piston reciprocatingly mounted in the cylinder, a piston rod extending slidably through an aperture in one said end of the cylinder and means for movably connecting the rod to the piston, whereby, when gas pressure rotates the valve member, the shaft can rotate and the rod can move without displacing the piston.

8. An exhaust brake as claimed in claim 7, wherein the means includes a resilient member which is deformed when the gas pressure rotates the valve member.

9. An exhaust brake as claimed in claim 8, wherein the resilient member is a spring.

10. An exhaust brake as claimed in claim 9, wherein the spring is a coil spring.

11. An exhaust brake as claimed in claim 9, wherein the piston rod has spaced-apart stop members thereon, permitting limited displacement of the piston rod with respect to the piston between the stops.

12. An exhaust brake as claimed in claim 11, wherein the spring is between the piston and a first said stop.

13. An exhaust brake as claimed in claim 12, wherein the first stop is the closest said stop to the one end of the cylinder, the spring being between said first stop and the piston.

14. An exhaust brake as claimed in claim 2, wherein the valve member is disk-like with a larger portion on one side of the pivot having a concave surface facing the upstream portion of the conduit.

15. An exhaust brake as claimed in claim 14, wherein the concave surface is scoop-like.

16. An exhaust brake as claimed in claim 15, wherein the valve member is flat on a side facing the downstream portion of the conduit.

17. An exhaust brake for internal combustion engines, comprising:

a valve body having an exhaust gas conduit therethrough with a longitudinal center, the conduit having a butterfly position and a downstream position extending from the butterfly position; and a butterfly valve member which closes the conduit at the butterfly position when closed, the valve member being pivotally mounted on a shaft which is offset from the longitudinal center of the conduit and which is spaced-apart from the butterfly position into the downstream portion of the conduit.

18. An exhaust brake as claimed in claim 17, wherein the valve member has a larger portion on one side of the shaft having a scoop shaped surface opposite the downstream portion of the conduit.

19. An exhaust brake as claimed in claim 18, wherein the shaft is operatively connected to a fluid actuator having a cylinder and a piston reciprocatingly received therein, a resilient member being operatively positioned between the piston and the butterfly valve member, whereby the valve member can open under the force of excess exhaust gas pressure without moving the piston.

20. A method of reducing excess gas pressure in diesel engine exhaust brakes of the type having an exhaust gas conduit with a butterfly valve member therein which occupies a plane when closed, the method comprising the step of:

mounting the butterfly valve member on a pivot which is spaced-apart from the plane of the valve member when closed and from the center of the conduit.

21. A method as claimed in claim 20, wherein the valve member is operatively connected to a fluid actuator having a cylinder and a piston reciprocatingly received therein, the method including the step of positioning a spring operatively between the valve member and the piston so the valve member can open under excess gas pressure without moving the piston.

* * * * *